US005990612A

United States Patent [19]

Konuma

[11] Patent Number: 5,990,612

[45] Date of Patent: Nov. 23, 1999

[54] FIELD EMITTER ARRAY WITH CAP MATERIAL ON ANODE ELECTRODE

[75] Inventor: Kazuo Konuma, Tokyo, Japan

[73] Assignee: Nec Corporation, Tokyo, Japan

[21] Appl. No.: 08/937,656

[22] Filed: Sep. 24, 1997

[30] Foreign Application Priority Data

Sep. 25, 1996 [JP] Japan ..... 8-253137

[51] Int. Cl.[6] ..... H01J 1/30; H01J 19/24

[52] U.S. Cl. ..... 313/495; 313/309; 313/351

[58] Field of Search ..... 313/422, 495, 313/496, 497, 309, 336, 351; 430/27; 445/24, 49

[56] References Cited

U.S. PATENT DOCUMENTS 5,827,101 10/1998 Cathey et al. ..... 495/24

OTHER PUBLICATIONS

Spindt et al., "Physical properties of thin–film field emission cathodes with molybdenum cones", Journal of Applied Physics, vol. 47, No. 12, 5248–5263 (1976) (Dec.).

Gray et al., "A Vacuum Field Effect Transistor Using Silcon Field Emitter Arrays", IEDM 86, 776–779 (1986) (No Month).

*Primary Examiner*—Michael Day
*Attorney, Agent, or Firm*—Foley & Lardner

[57] ABSTRACT

A field emitter array comprises a plurality of cathode electrodes and an anode electrode disposed opposite to the plurality of cathode electrodes. And the anode electrode is provided with a plurality of protrusions having a cap material disposed on the tip of each protrusion. A voltage below a designated value is applied between a gate electrode and the cathode electrodes, and electrons are released only from a cathode electrode with a low emission start voltage. When the electrons are emitted to the cap material provided on the protrusions, the cap material is sputtering-evaporated and is affixed to the cathode electrode. Then a cap is disposed on the each of the cathode electrodes. Then, the emission properties between each cathode electrode are consequently rendered uniform, thereby increasing the emission start voltage and maximum applied voltage of the overall field emitter array.

6 Claims, 3 Drawing Sheets

FIELD EMITTER ARRAY WITH CAP MATERIAL ON ANODE ELECTRODE

BACKGROUND OF THE INVENTION

1. Field of the Invention

The present invention relates to a field emitter array comprising a plurality of cathode electrodes and to a manufacturing method and driving method of the same.

2. Description of the Related Art

Conventional field emitters have been disclosed by C. A. Spindt et. al in J.A. Vol. P47 pp. 5248–5263 (1976) and H. F. Gray et. al in IEDM 86 pp. 776–779 (1986).

When a field emitter is used as an electron gun for a CRT display or as a electron source for a TWT (traveling wave tube), an electron beam with a large emission volume and a narrow emission spread is required. In the above conventional field emitters, a field emitter array comprising a plurality of cathode electrodes is employed to obtain this type of electron beam.

As shown in FIG. 1, this conventional field emitter array consists of a substrate 4, an insulating film 5 having a plurality of gate holes 3 formed on the substrate 4, a gate electrode 2 formed on the insulating film 5, a plurality of cathode electrodes 1 formed on the substrate 4 in each of the gate holes 3 for emitting electrons and an anode electrode 11 formed opposite to the cathode electrodes 1 for receiving electrons emitted from the cathode electrodes 1.

When a positive voltage above a predetermined value is applied to the cathode electrode 1, an electron 6 is released from near the tip of the conical cathode electrode 1. Emission properties such as the volume of electrons 6 emitted at a fixed voltage and the minimum voltage at which electrons 6 are allowed to emit depend on the shape of the cathode electrode 1, the distance between the gate electrode 2 and the cathode electrode 1, the size of the gate hole 3 of the gate electrode 2 and such like. An emitted electron 6 is radiated to an anode electrode 11 provided opposite to the cathode electrodes 1.

In the above-mentioned conventional field emitter array comprising a plurality of cathode electrodes, the emission properties of the cathode electrode vary due to the variations in the size of the gate holes, the distance between the gate electrode and the cathode electrode and the shape of the tip of the cathode electrode. Consequently, the upper threshold applied voltage, that is, the maximum value of the voltage which can be applied between the gate electrode and the cathode electrode, varies. If a voltage exceeding the upper threshold applied voltage is applied between the gate electrode and the cathode electrode, it causes an electrical short between the two electrodes to thereby destroy the field emitter array. If the applied voltage of the field emitter array is made equal to the cathode electrode which has the lowest applicable voltage in order to avoid this, there have been the problems that the overall current density of the field emitter array is not sufficiently high and a large volume of emission can not be obtained.

SUMMARY OF THE INVENTION

It is therefore an object of the present invention to provide a field emitter array in which the upper threshold applied voltage can be increased and a large volume of emission can be obtained.

In order to achieve the above objective, a field emitter array according to the present invention comprises a plurality of cathode electrodes and an anode electrode having a plurality of protrusions each facing the cathode electrodes and a cap material is disposed on the tip of the each protrusions.

A field emitter array of the present invention further comprises:

- a substrate;
- an insulating film formed on said substrate, said insulating film having a plurality of holes;
- a gate electrode formed on the insulating film;
- a plurality of cathode electrodes each formed in the plurality of holes of the insulating film, for emitting electrons;
- an anode electrode, opposite to the substrate and having a plurality of protrusions facing each of the cathode electrodes for receiving an electron emitted from the cathode electrodes; and
- a cap material formed on the tip of each protrusion, for controlling a volume of electrons emitted from the cathode electrode.

According to the present invention, variation in emission properties is rendered uniform by covering the tip of a cathode electrode which has a comparatively low emission start voltage (a voltage applied between a gate electrode and the cathode electrodes at which electrons are first released) with cap material for controlling electron release, thereby raising the maximum applied voltage. Therefore, the voltage applied to the overall field emitter array can be increased and a large volume of emission can be secured.

According to an embodiment of the present invention, the cap material comprises alumina or silicon dioxide.

According to another embodiment of the present invention, the cap material comprises an electrically insulating substance.

According to another embodiment of the present invention, the cap material comprises a substance having a work function greater than Mo (molybdenum).

According to another embodiment of the present invention, the cap material comprises a substance which modifies a shape of a tip of the cathode electrode when said cap material is affixed to said cathode electrode.

Furthermore, a field emitter array manufacturing method of the present invention comprises a steps of pressing an electrode formed by uniting an anode electrode and a replica anode electrode onto a gate electrode in such a manner that the replica anode electrode assumes a protruding shape reflecting an indented shape of a gate hole; and a steps of fitting cap material only to a tip of a protrusion of the replica anode electrode.

According to the present invention, a tip of an anode electrode corresponding precisely to a cathode electrode can be easily formed.

Furthermore, according to a field emitter array driving method of the present invention, a voltage is applied to an anode electrode so that a cap material for controlling the volume of electrons to be emitted is affixed only to a cathode electrode which releases an electron at a voltage between a gate electrode and a cathode electrode which is below a predetermined value.

According to the present invention, under conditions in which a voltage applied between a gate electrode and a cathode electrode causes no electrons to be released from a great plurality of cathode electrodes, a cap for controlling the volume of electrons released is selectively affixed to the tip of a cathode electrode which releases electrons even under those conditions. Therefore, the voltage applied to the overall field emitter array can be increased and a large volume of emission can be secured.

According to the present invention, the upper threshold applied voltage can be increased and a large volume of emission can be obtained in a field emitter array comprising a plurality of cathode electrodes with varying emission properties. In addition, the destruction of the field emitter array due to application of an excessive voltage can be prevented.

The above and other objects, features, and advantages of the present invention will become apparent from the following description with references to the accompanying drawings which illustrate examples of the present invention.

DETAILED DESCRIPTION OF THE PREFERRED EMBODIMENTS

Figure 1:
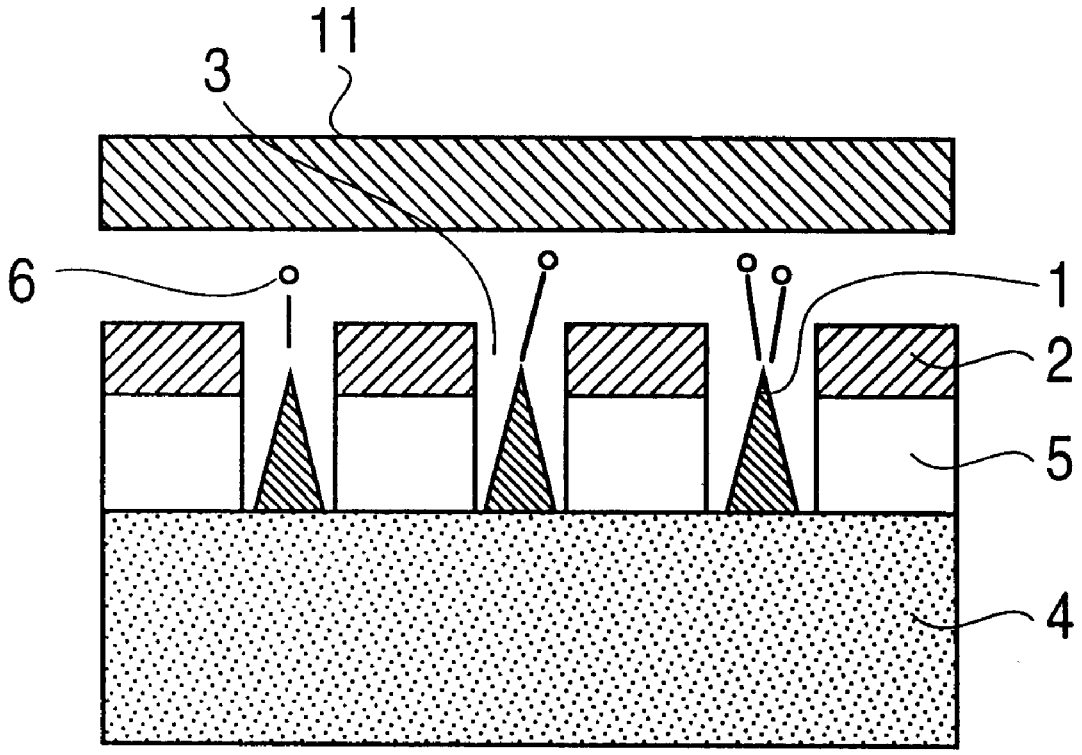
FIG. 1 (PRIOR ART)
FIG. 1 is a cross sectional view of a conventional field emitter array.
Figure 2:
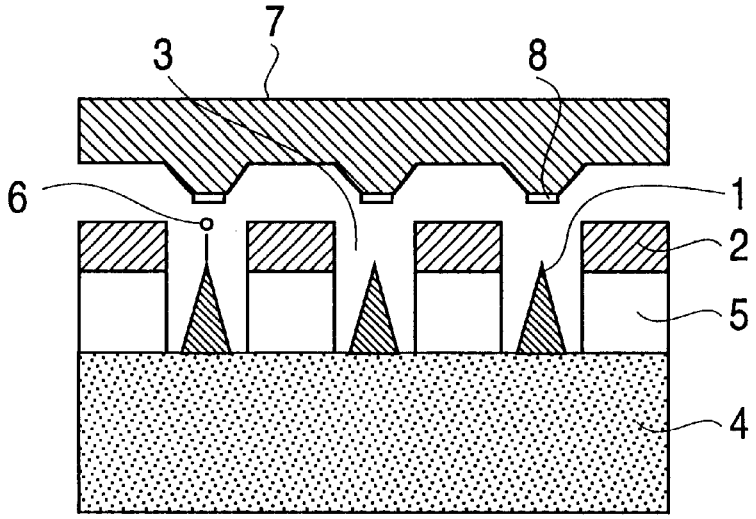
FIG. 2 is a cross sectional view of a field emitter array according to an embodiment of the present invention prior to voltage application.

Referring now to FIG. 2, a field emitter array of an embodiment according to the present invention comprises a substrate 4, an insulating film 5, a gate electrode 2, a cathode electrode 1, an anode electrode 7 and a cap material 8. The substrate 4 serves as a foundation for the field emitter array. The insulating film 5 is disposed on the substrate 4 has a plurality of holes and electrically insulates the gate electrode 2 from the substrate 4. This insulating film 5 consists of silicon dioxide and has a thickness of 0.5 μm. The gate electrode 2 is disposed on the insulating film 5 and has a gate hole 3 for releasing electrons. The thickness of this gate electrode 2 is 200 μm; the gate hole 3 is round or polygonal in shape and ordinarily has a diameter (longest diagonal in the case of a polygon) within the range 0.1–1.0 μm. In the present embodiment, the diameter of the gate hole 3 is 0.4 μm. The spacing between two adjacent gate holes 3 is usually 0.1–1.0 μm. The cathode electrode 1 is disposed in the gate hole 3 on the substrate 4. In the present embodiment, 1000 cathode electrodes 1 are disposed with the space of 1.2 μm. Furthermore, each cathode electrode 1 is conical in shape with a height of 0.6 μm and is manufactured through evaporation method using molybdenum as a electrode material. The anode electrode 7 is formed opposite to the substrate 4 and has protruding portions facing the cathode electrodes 1 in equal alignment thereto for receiving electrons emitted from the cathode electrodes 1. Furthermore, cap material 8 is formed on the tips of these protrusions. This cap material 8 has a thickness of 1 μm and is formed for instance from an insulating substance such as alumina and silicon dioxide. A movable mechanism (not shown) is equipped that disposes the anode electrode 7 directly above the substrate 4 and removed from this position.

Figure 3:
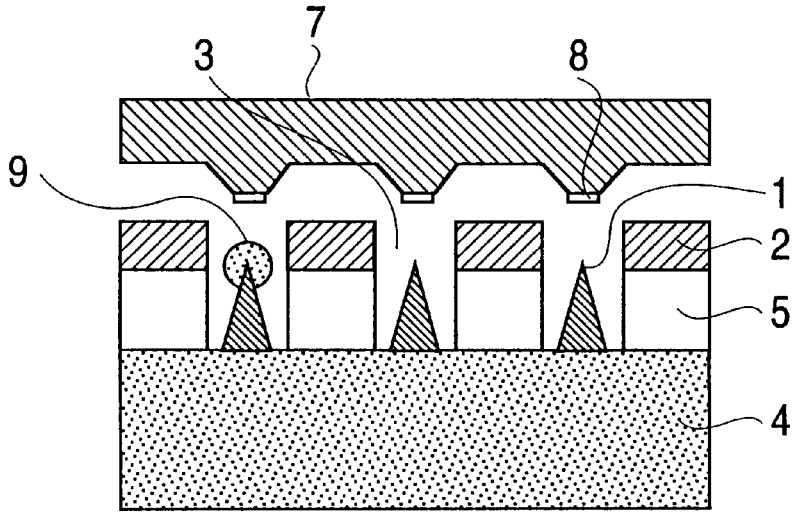
FIG. 3 is a cross sectional view of a field emitter array according to an embodiment of the present invention after voltage application.

Next, the operation of the present embodiment will be explained with reference to FIG. 3.

Firstly, a voltage to be applied between the gate electrode 2 and the cathode electrode 1 is selected. Since in the present embodiment the threshold of the applied voltage is determined as 50 V, a minimum emission start voltage below this threshold is selected and applied between the gate electrode 2 and the cathode electrode 1.

A voltage to be applied to the anode electrode 7 is usually equal to or higher than the potential at the gate electrode 2. When determining this voltage, consideration must be given to the balance of the spread of electrons 6 emitted from the cathode electrode 1 and the spread control effect based on the field created by the gate electrode 2 and the anode electrode 7. Half of the spread degree of emitted electrons 6 is said to be within 20°. Furthermore, the initial speed of the electrons 6 when released is proportional to the square of the voltage applied between the gate electrode 2 and the cathode electrode 1. Electrons 6 emitted at this speed are then accelerated in the direction of the normal by the electric field formed between the gate electrode 2 and the anode electrode 7. Increasing the strength of this electric field reduces the spread of the electrons 6 when they have reached the anode electrode 7. It is therefore possible to reduce the size of the cap material 8 formation regions and the intervals between these regions. However, when the electric field between the gate electrode 2 and the anode electrode 7 becomes extremely strong, emission of electrons 6 from the cathode electrode 1 is induced not by the electric field between the gate electrode 2 and the cathode electrode 1 but by the electric field between the gate electrode 2 and the anode electrode 7. The voltage to be applied between the gate electrode 2 and the anode electrode 7 is determined after due consideration of the above points.

Furthermore, following consideration of the spread of emitted electrons, consideration must also be given to setting of the distance and potential difference between the gate electrode 2 and the anode electrode 7. Even with the same electric field, the spread of electrons 6 becomes wide when the distance between the two electrodes is large. Alternatively, when this distance is small, the effect due to the variation in distance between the gate electrode 2 corresponding to each cathode electrode 1 and the anode electrode 7 becomes noticeable. In an extreme case, where the positioning precision between the gate electrode 2 and the cathode electrode 1 is 0.5 μm and the distance between the gate electrode 2 and the cathode electrode 1 is set to 0.5 μm, the actual distances varies from 0 μm to 1.0 μm. In addition, since the energy per electron increases with the increase of the potential difference between the gate electrode 2 and the anode electrode 7, the volume of sputtering evaporation or heating evaporation of the cap material 8 by released electrons also increases.

After consideration of the above points, the distance between the gate electrode 2 and the anode electrode 7 was set at 10 μm and the voltage to be applied between the gate electrode 2 and the anode electrode 7 was set at 500 V. Due to these conditions, the spread of electrons 6 emitted from the cathode electrode 1 is controlled and the electrons are concentrated on a minute region of the cap material 8. Since the potential of the anode electrode 7 is high, the energy per electron of electrons 6 radiated onto the cap material 8 is also high, thereby increasing the volume of the cap material 8 to sputtering-evaporation or heating.

When voltage is applied in this state for 5 hours, if any of the cathode electrodes 1 has a emission start voltage below the applied voltage, electrons 6 are emitted only from that cathode electrode 1; the emitted electrons 6 are then radiated to the cap material 8 disposed on the tip of a protrusion of the anode electrode 7 corresponding to the cathode electrode 1. The cap material 8 radiated by these electrons 6 is sputter-evaporated and positively ionized, and is deposited on the cathode electrode 1 which is the substance of lowest potential in the near vicinity, thereby forming a cap 9 on the cathode electrode 1 as shown in FIG. 3.

After this cap 9 has been formed, the anode electrode 7 on which the cap material 8 had been disposed is removed from its position opposite to the substrate 4. Then an anode electrode 7 which is not provided with cap material 8 is positioned opposite to the substrate 4 to complete the field emitter array.

The emission start voltage and maximum applied voltage of a cathode electrode 1 upon which a cap 9 has been formed are higher than they were prior to formation of the cap 9. As a result, there are now no cathode electrodes 1 in the field emitter array which have an emission start voltage below the voltage applied when the cap 9 was formed and thus the emission start voltage and the maximum applied voltage of the entire field emitter array are increased. (Consequently, a voltage above the voltage prior to formation of the cap 9 can be applied to the field emitter array and a greater emission volume can be secured.

The present embodiment described an example in which an insulating substance was used as the cap material 8, but the cap material 8 is not restricted to insulating substance and any material with a high work function which will control the emission of electrons 6 when affixed to the cathode electrode 1 may acceptably be used. For instance, Si (silicon) which a work function greater than the work function of Mo (molybdenum), i.e., 4.3 eV may be employed as cap material 8. Furthermore, similar effects can be obtained by using any material capable of altering and blunting the shape of the tip of a cathode electrode 1, even a material with a low work function.

Manufacturing processes of a field emitter array depicted in FIGS. 2 and 3 will be explained with reference to FIGS. 4*a*, 4*b* and 4*c*.

Figure 4A:
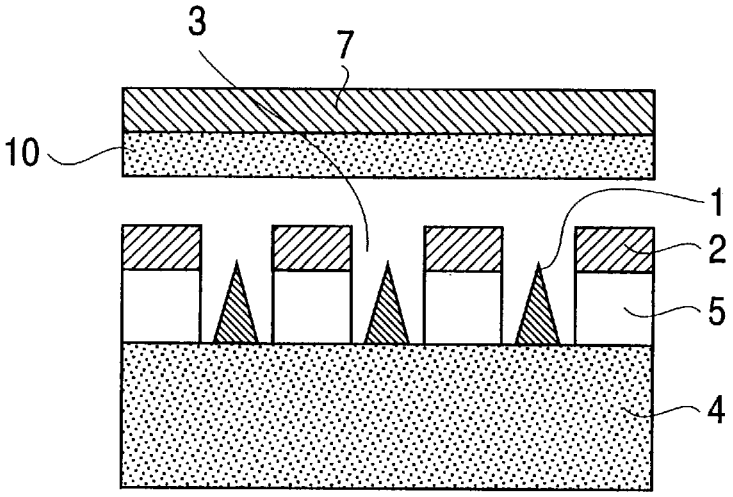
FIG. 4*a*~4*c* are cross sectional views showing manufacturing processes of the field emitter array shown in FIGS. 2 and 3.

In FIG. 4*a*, a replica anode electrode 10 consists of conductive material softer than the anode electrode 7 and the gate electrode 2. For instance, if tungsten is used to form the anode electrode 7 and the gate electrode 2, gold must be used for the replica anode electrode 10. A material consisting of organic material mixed with metallic powder is sometimes used.

Figure 4B:
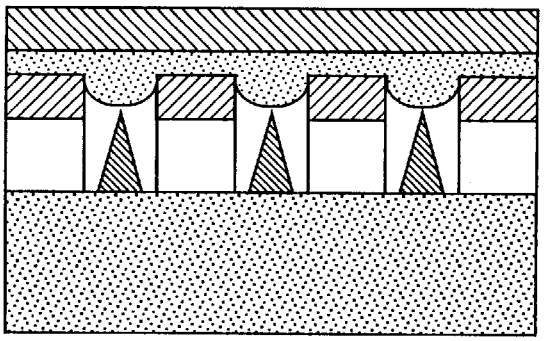
Figure 4C:
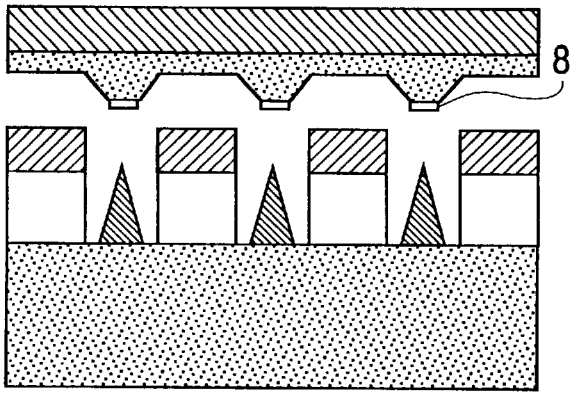

In FIG. 4*b*, an electrode formed by uniting the anode electrode 7 and the replica anode electrode 10 is pressed hard onto the gate electrode 2. The force with which the electrode is pressed should be sufficient so that the indentations of the gate holes 3 reflect onto the replica anode electrode 10 thereby producing protrusions, in other words the gate holes 3 are replicated on the replica anode electrode 10. After the replica anode electrode 10 has been altered to this replicated shape according to the process in FIG. 4*b*, the unified body comprising the replica anode electrode 10 and the anode electrode 7 is dipped into alumina liquid so that alumina is deposited only the tips of the protrusions. A cap material 8 can be formed on the tip of the protrusion of the replica anode electrode 10 through subsequent drying processing. Thereafter, the cathode electrode 1 and the cap material 8 are set opposite to each other once again as shown in FIG. 4*c*.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A field emitter array comprising:

a plurality of emitters having tips for emitting electrons; and an anode electrode having a plurality of protrusions directly facing each of said emitter tips, said each protrusions having a cap material on the tip thereof.

2. A field emitter array comprising:

a substrate;

an insulating film formed on said substrate, said insulating film having a plurality of holes;

a gate electrode formed on the insulating film;

a plurality of cathode electrodes each formed in the plurality of holes of the insulating film, for emitting electrons;

an anode electrode, opposite to the substrate and having a plurality of protrusions directly aligned with each of the cathode electrodes for receiving an electron emitted from the cathode electrodes; and a cap material formed on the tip of each protrusion, for controlling a volume of electrons emitted from the cathode electrode.

3. A field emitter array according to claim 2, wherein said cap material comprises alumina or silicon dioxide.

4. A field emitter array according to claim 2, wherein said cap material comprises an electrically insulating substance.

5. A field emitter array according to claim 2, wherein said cap material comprises a substance having a work function greater than Mo (molybdenum).

6. A field emitter array according to claim 2, wherein said cap material comprises a substance which is sputtered therefrom upon electron bombardment so as to be deposited on at least one cathode electrode thereby modifying the shape of a tip of the at least one cathode electrode.

* * * * *